US008276385B2

(12) United States Patent
Zuo et al.

(10) Patent No.: US 8,276,385 B2
(45) Date of Patent: Oct. 2, 2012

(54) STAGED MULTI-TUBE PREMIXING INJECTOR

(75) Inventors: Baifang Zuo, Simpsonville, SC (US); Abdul Rafey Khan, Greenville, SC (US); William David York, Greer, SC (US); Willy Steve Ziminsky, Greenville, SC (US)

(73) Assignee: General Electric Company, Schenectady, NY (US)

( * ) Notice: Subject to any disclaimer, the term of this patent is extended or adjusted under 35 U.S.C. 154(b) by 618 days.

(21) Appl. No.: 12/575,929

(22) Filed: Oct. 8, 2009

(65) Prior Publication Data

US 2011/0083439 A1 Apr. 14, 2011

(51) Int. Cl.
*F02C 1/00* (2006.01)

(52) U.S. Cl. ..... 60/737; 60/742; 239/419.5

(58) Field of Classification Search ..... 60/737, 60/740, 742, 746, 747; 239/132.5, 419, 419.3, 239/419.5, 423, 424, 424.5, 427, 427.3, 427.5, 239/428, 430, 433, 556, 557
See application file for complete search history.

(56) References Cited

U.S. PATENT DOCUMENTS 4,100,733 A * 7/1978 Striebel et al. ..... 60/39.463
5,904,477 A 5/1999 Van Dam et al.
8,157,189 B2 * 4/2012 Johnson et al. ..... 239/132.5
8,181,891 B2 * 5/2012 Ziminsky et al. ..... 239/430
2010/0031662 A1 * 2/2010 Zuo ..... 60/740
2010/0192581 A1 * 8/2010 Ziminsky et al. ..... 60/737

FOREIGN PATENT DOCUMENTS

EP 0845592 B1 8/2003

OTHER PUBLICATIONS

Thomas Edward Johnson et al., pending U.S. Appl. No. 12/417,896 entitled "Premixing Direct Injector," filed with the U.S. Patent and Trademark Office on Apr. 3, 2009.

* cited by examiner

*Primary Examiner* — Phutthiwat Wongwian
(74) *Attorney, Agent, or Firm* — Cantor Colburn LLP

(57) ABSTRACT

A fuel injection nozzle includes a body member having an upstream wall opposing a downstream wall, and an internal wall disposed between the upstream wall and the downstream wall, a first chamber partially defined by the an inner surface of the upstream wall and a surface of the internal wall, a second chamber partially defined by an inner surface of the downstream wall and a surface of the internal wall a first gas inlet communicative with the first chamber operative to emit a first gas into the first chamber, a second gas inlet communicative with the second chamber operative to emit a second gas into the second chamber, and a plurality of mixing tubes, each of the mixing tubes having a tube inner surface, a tube outer surface, a first inlet communicative with an aperture in the upstream wall operative to receive a third gas.

20 Claims, 2 Drawing Sheets

STAGED MULTI-TUBE PREMIXING INJECTOR

FEDERAL RESEARCH STATEMENT

This invention was made with Government support under Government Contract #DE-FC26-05NT42643 awarded by Department of Energy. The Government has certain rights in this invention.

BACKGROUND OF THE INVENTION

The subject matter disclosed herein relates to fuel injectors for turbine engines.

Gas turbine engines may operate using a number of different types of fuels, including natural gas and other hydrocarbon fuels. Other fuels, such as, for example hydrogen (H2) and mixtures of hydrogen and nitrogen may be burned in the gas turbine, and may offer reductions of emissions of carbon monoxide and carbon dioxide.

Hydrogen fuels often have a higher reactivity than natural gas fuels, causing hydrogen fuel to combust more easily. Thus, fuel nozzles designed for use with natural gas fuels may not be fully compatible for use with fuels having a higher reactivity. At the same time, fuel nozzles designed for high-reactivity fuels may not be optimized to deliver low emissions levels for natural gas fuels.

BRIEF DESCRIPTION OF THE INVENTION

According to one aspect of the invention, a fuel injection nozzle includes a body member having an upstream wall opposing a downstream wall, and an internal wall disposed between the upstream wall and the downstream wall, a first chamber partially defined by the an inner surface of the upstream wall and a surface of the internal wall, a second chamber partially defined by an inner surface of the downstream wall and a surface of the internal wall, a first gas inlet communicative with the first chamber operative to emit a first gas into the first chamber, a second gas inlet communicative with the second chamber operative to emit a second gas into the second chamber, and a plurality of mixing tubes, each of the mixing tubes having a tube inner surface, a tube outer surface, a first inlet communicative with an aperture in the upstream wall operative to receive a third gas, a second inlet communicative with the tube outer surface and the tube inner surface operative to translate the first gas into the mixing tube, a third inlet communicative with the tube outer surface and the tube inner surface operative to translate the second gas in to the mixing tube, a mixing portion operative to mix the first gas, the second gas, and the third gas, and an outlet communicative with an aperture in the downstream wall operative to emit the mixed first, second, and third gasses.

According to another aspect of the invention, a fuel injection system includes a first gas source, a second gas source, an air source, a fuel injection nozzle having a body member having an upstream wall opposing a downstream wall, and an internal wall disposed between the upstream wall and the downstream wall, a first chamber partially defined by the an inner surface of the upstream wall and a surface of the internal wall; a second chamber partially defined by an inner surface of the downstream wall and a surface of the internal wall; a first gas inlet communicative with the first chamber and the first gas source operative to emit a first gas into the first chamber; a second gas inlet communicative with the second chamber and the second gas source operative to emit a second gas into the second chamber; and a plurality of mixing tubes, each of the mixing tubes having a tube inner surface, a tube outer surface, a first inlet communicative with an aperture in the upstream wall operative to receive a third gas from the air source, a second inlet communicative with the tube outer surface and the tube inner surface operative to translate the first gas into the mixing tube, a third inlet communicative with the tube outer surface and the tube inner surface operative to translate the second gas in to the mixing tube, a mixing portion operative to mix the first gas, the second gas, and the third gas, and an outlet communicative with an aperture in the downstream wall operative to emit the mixed first, second, and third gasses.

According to yet another aspect of the invention, a gas turbine engine system includes a combustor portion, and a fuel injection nozzle having a body member having an upstream wall opposing a downstream wall, and an internal wall disposed between the upstream wall and the downstream wall, a first chamber partially defined by the an inner surface of the upstream wall and a surface of the internal wall; a second chamber partially defined by an inner surface of the downstream wall and a surface of the internal wall; a first gas inlet communicative with the first chamber and a first gas source operative to emit a first gas into the first chamber; a second gas inlet communicative with the second chamber and a second gas source operative to emit a second gas into the second chamber; and a plurality of mixing tubes, each of the mixing tubes having a tube inner surface, a tube outer surface, a first inlet communicative with an aperture in the upstream wall operative to receive a third gas from the air source, a second inlet communicative with the tube outer surface and the tube inner surface operative to translate the first gas into the mixing tube, a third inlet communicative with the tube outer surface and the tube inner surface operative to translate the second gas in to the mixing tube, a mixing portion operative to mix the first gas, the second gas, and the third gas, and an outlet communicative with an aperture in the downstream wall operative to emit the mixed first, second, and third gasses into the combustor portion.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Gas turbine engines may operate using a variety of fuels. The use of natural gas (NG) and synthetic gas (Syngas), for example, offers savings in fuel cost and decreases carbon and other undesirable emissions. Some gas turbine engines inject the fuel into a combustor where the fuel mixes with an air stream and is ignited. One disadvantage of mixing the fuel and air in the combustor is that the mixture may not be uniformly mixed prior to combustion. The combustion of a non-uniform fuel air mixture may result in some portions of the mixture combusting at higher temperatures than other portions of the mixture. Locally-higher flame temperatures may drive higher emissions of undesirable pollutants such as NOx.

One method for overcoming the non-uniform fuel/air mixture in the combustor includes mixing the fuel and air prior to injecting the mixture into the combustor. The method is performed by, for example, a multi-tube fuel nozzle. The use of a multi-tube fuel nozzle to mix, for example, natural gas and air allows a uniform mixture of fuel and air to be injected into the combustor prior to ignition of the mixture. Hydrogen gas (H2), Syngas, and mixtures of hydrogen and, for example, nitrogen gas used as fuel offer a further reduction in pollutants emitted from the gas turbine.

Figure 1:
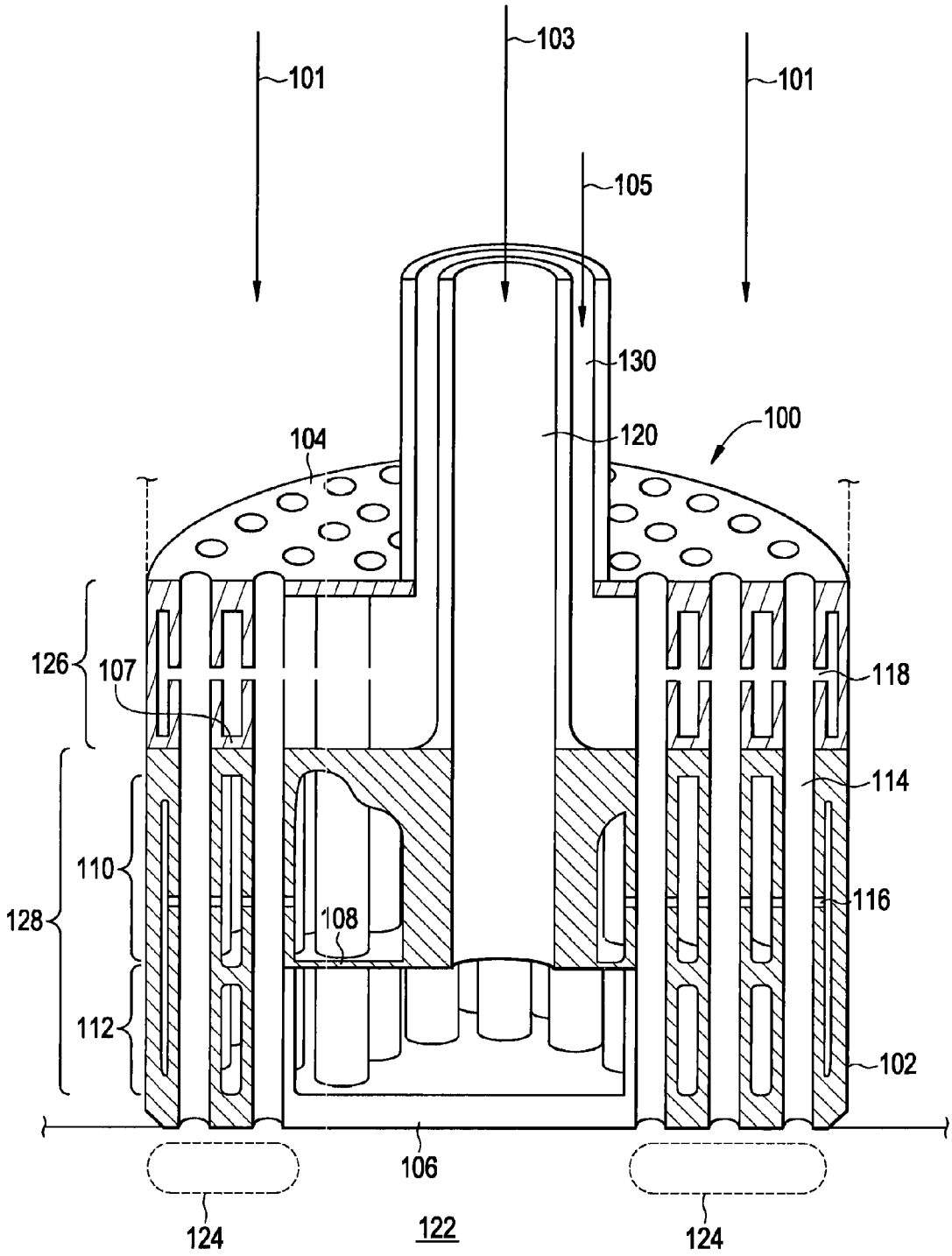
FIG. 1 is a perspective, partially cut-away view of an exemplary embodiment of a portion of a multi-tube fuel nozzle.

FIG. 1 illustrates a perspective, partially cut-away view of an exemplary embodiment of a portion of a multi-tube fuel nozzle 100 (injector). The injector 100 includes a body member 102 having an upstream wall 104, an interior wall 107, and a downstream wall 106. The upstream wall 104 and the interior wall 107 define a first gas chamber 126. A baffle member 108 is disposed in the body member 102, and defines an upstream chamber 110 and a downstream chamber 112 of a second gas chamber 128. A plurality of mixing tubes 114 is disposed in the body member 102. The mixing tubes 114 include inlets 118 communicative between the first gas chamber 126 and an inner surface of the mixing tubes 114, and inlets 116 communicative between the upstream chamber 110 and the inner surface of the mixing tubes 114.

In operation, air flows along a path indicated by the arrow 101. The air enters the mixing tubes 114 via apertures in the upstream wall 104. A first gas, such as, for example, natural gas, syngas, hydrogen gas, air, an inert gas, or a mixture of gasses flows along a path indicated by the arrow 105 through a first fuel cavity 130. The first gas enters the body member 102 in the first gas chamber 126. The first gas flows radially outward from the center of the first gas chamber 126. The first gas enters the inlets 118 and flows into the mixing tubes 114. A second gas such as, for example, natural gas, syngas, hydrogen gas, air, an inert gas, or a mixture of gasses flows along a path indicated by the arrow 103 through a second gas cavity 120 into the second gas chamber 128. The second gas enters the body member 102 in the downstream chamber 112. The second gas flows radially outward from the center of the down stream chamber 112 and into the upstream chamber 110. The second gas enters the inlets 116 and flows into the mixing tubes 114. The first gas, the second gas, and air mix in the mixing tubes 114 and are emitted as a fuel-air mixture from the mixing tubes into a combustor portion 122 of a turbine engine. The fuel-air mixture combusts in a reaction zone 124 of the combustor portion 122.

Figure 2:
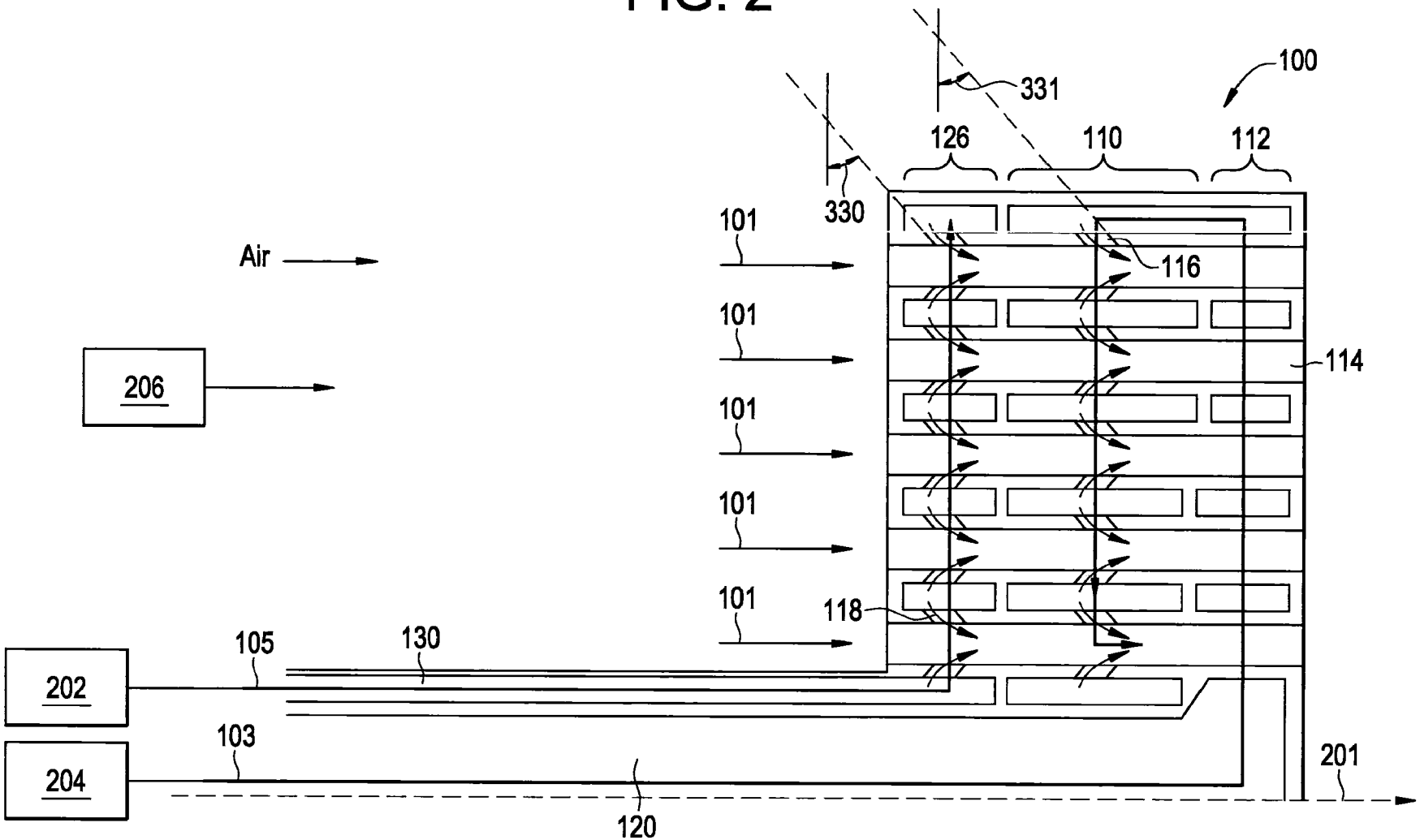
FIG. 2 is a side cut-away view of a portion of the multi-tube fuel nozzle of FIG. 1.

FIG. 2 illustrates a side cut-away view of a portion of the injector 100, and will further illustrate the operation of the injector 100. The first gas flow is shown by the arrow 105. The first gas (from a first gas source 202) enters the first gas chamber 126 via the first gas cavity 130 along a path parallel to the center axis 201 of the injector 100. The first gas flows enters the mixing tubes 114 through the inlets 118 and mixes with the air (shown by the arrows 101) in the mixing tubes 114. In the illustrated embodiment, the inlets 118 may be angled with respect to the axial direction to promote the fuel to be injected at an angle 330 of between 20 and 90 degrees. The second gas flow is shown by the arrow 103. The second gas (from a second gas source 204) enters the downstream chamber 112 along a path parallel to the center axis 201 of the injector 100. When the second gas enters the downstream chamber 112, the second gas flows radially outward from the center axis 201. The second gas flows into the upstream chamber 110 after passing an outer lip of the baffle member 108. The second gas flows through the upstream chamber 110, enters the inlets 116, and flows into the mixing tubes 114. In the illustrated embodiment, the inlets 116 may be angled with respect to the axial direction to promote the fuel to be injected at an angle 331 of between 20 and 90 degrees. The fuel-air mix is created in the mixing tubes 114, downstream from the inlets 116. The second gas may be cooler than the air. The flow of the second gas around the surface of the mixing tubes 114 in the downstream chamber 112 cools the mixing tubes 114 and helps to prevent the ignition or sustained burning of the fuel-air mixture inside the mixing tubes 114. The illustrated embodiment includes a third fuel source 206 that may be mixed with the air prior to entering the nozzle 100. For example, the third fuel source may include natural gas such that the air is mixed to include 10%-20% natural gas prior to entering the mixing tubes 114.

The illustrated embodiment includes the upstream chamber 110 and the downstream chamber 112. Other embodiments may include any number of additional chambers arranged in a similar manner.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A fuel injection nozzle comprising:

a body member having an upstream wall opposing a downstream wall, and an internal wall disposed between the upstream wall and the downstream wall;

a first chamber partially defined by the an inner surface of the upstream wall and a surface of the internal wall;

a second chamber partially defined by an inner surface of the downstream wall and a surface of the internal wall;

a first gas inlet communicative with the first chamber operative to emit a first gas into the first chamber;

a second gas inlet communicative with the second chamber operative to emit a second gas into the second chamber; and a plurality of mixing tubes, each of the mixing tubes having a tube inner surface, a tube outer surface, a first inlet communicative with an aperture in the upstream wall operative to receive a third gas, a second inlet communicative with the tube outer surface and the tube inner surface operative to translate the first gas into the mixing tube, a third inlet communicative with the tube outer surface and the tube inner surface operative to translate the second gas into the mixing tube, a mixing portion operative to mix the first gas, the second gas, and the third gas, and an outlet communicative with an aperture in the downstream wall operative to emit the mixed first, second, and third gasses.

2. The fuel injection nozzle of claim 1, further comprising a baffle member disposed in the second chamber.

3. The fuel injection nozzle of claim 1, wherein the nozzle defines a first gas flow path defined by the first gas inlet, the first chamber, and the second inlet.

4. The fuel injection nozzle of claim 1, wherein the nozzle defines a second gas flow path defined by the second gas inlet, the second chamber, and the third inlet.

5. The fuel injection nozzle of claim 1, wherein each mixing tube defines an air flow path.

6. The fuel injection nozzle of claim 1, wherein the body member is tubular having a centered longitudinal axis parallel to the flow of the third gas.

7. The fuel injection nozzle of claim 1, wherein the first gas is a fuel.

8. The fuel injection nozzle of claim 1, wherein the second gas is a fuel.

9. The fuel injection nozzle of claim 1, wherein the third gas includes air.

10. A fuel injection system comprising:

a first gas source;

a second gas source;

an air source;

a fuel injection nozzle having a body member having an upstream wall opposing a downstream wall, and an internal wall disposed between the upstream wall and the downstream wall, a first chamber partially defined by the an inner surface of the upstream wall and a surface of the internal wall; a second chamber partially defined by an inner surface of the downstream wall and a surface of the internal wall; a first gas inlet communicative with the first chamber and the first gas source operative to emit a first gas into the first chamber; a second gas inlet communicative with the second chamber and the second gas source operative to emit a second gas into the second chamber; and a plurality of mixing tubes, each of the mixing tubes having a tube inner surface, a tube outer surface, a first inlet communicative with an aperture in the upstream wall operative to receive a third gas from the air source, a second inlet communicative with the tube outer surface and the tube inner surface operative to translate the first gas into the mixing tube, a third inlet communicative with the tube outer surface and the tube inner surface operative to translate the second gas into the mixing tube, a mixing portion operative to mix the first gas, the second gas, and the third gas, and an outlet communicative with an aperture in the downstream wall operative to emit the mixed first, second, and third gasses.

11. The system of claim 10, further comprising a baffle member disposed in the second chamber.

12. The system of claim 10, wherein the nozzle defines a first gas flow path defined by the first gas inlet, the first chamber, and the second inlet.

13. The system of claim 10, wherein the nozzle defines a second gas flow path defined by the second gas inlet, the second chamber, and the third inlet.

14. The system of claim 10, wherein each mixing tube defines an air flow path.

15. The system of claim 10, wherein the body member is tubular having a centered longitudinal axis parallel to the flow of the third gas.

16. The system of claim 10, wherein the first gas is a fuel.

17. The system of claim 10, therein the second gas is a fuel.

18. The system of claim 10, wherein the third gas includes a fuel.

19. A gas turbine engine system comprising:

a combustor portion; and a fuel injection nozzle having a body member having an upstream wall opposing a downstream wall, and an internal wall disposed between the upstream wall and the downstream wall, a first chamber partially defined by the an inner surface of the upstream wall and a surface of the internal wall; a second chamber partially defined by an inner surface of the downstream wall and a surface of the internal wall; a first gas inlet communicative with the first chamber and a first gas source operative to emit a first gas into the first chamber; a second gas inlet communicative with the second chamber and a second gas source operative to emit a second gas into the second chamber; and a plurality of mixing tubes, each of the mixing tubes having a tube inner surface, a tube outer surface, a first inlet communicative with an aperture in the upstream wall operative to receive a third gas from the air source, a second inlet communicative with the tube outer surface and the tube inner surface operative to translate the first gas into the mixing tube, a third inlet communicative with the tube outer surface and the tube inner surface operative to translate the second gas into the mixing tube, a mixing portion operative to mix the first gas, the second gas, and the third gas, and an outlet communicative with an aperture in the downstream wall operative to emit the mixed first, second, and third gasses into the combustor portion.

20. The system of claim 19, further comprising a baffle member disposed in the second chamber.

* * * * *